United States Patent [19]

Ray et al.

[11] Patent Number: 4,637,548

[45] Date of Patent: Jan. 20, 1987

[54] RELEASABLE LOCKING ASSEMBLY FOR SPRINKLER VALVE UNITS

[75] Inventors: Charles A. Ray, Arcadia; Samuel C. Walker, Diamond Bar, both of Calif.

[73] Assignee: Anthony Manufacturing Corp., Azusa, Calif.

[21] Appl. No.: 630,227

[22] Filed: Jul. 12, 1984

[51] Int. Cl.[4] ..... B05B 15/06

[52] U.S. Cl. ..... 239/201; 285/321

[58] Field of Search ..... 239/570, 571, 202–206, 239/207, 200, 201, 569; 285/321; 403/DIG. 4

[56] References Cited

U.S. PATENT DOCUMENTS

| | | | |
|---|---|---|---|
| 2,438,107 | 3/1948 | Babbitt | 285/321 |
| 2,709,623 | 5/1955 | Glynn | 239/201 |
| 2,968,440 | 1/1961 | Cone | 239/203 |
| 3,100,121 | 8/1963 | Hillmer | 285/321 |
| 3,326,580 | 1/1967 | Munier et al. | 285/321 |
| 3,439,943 | 4/1969 | Thorne-Thomsen | 285/321 |
| 3,603,619 | 9/1971 | Bengesser et al. | 285/321 |
| 4,081,171 | 3/1978 | Morgan et al. | 251/30 |
| 4,082,321 | 4/1978 | Nakajima et al. | 285/321 |
| 4,226,259 | 10/1980 | Szekely et al. | 137/269 |

*Primary Examiner*—Joseph F. Peters, Jr.
*Assistant Examiner*—Scott Malpede
*Attorney, Agent, or Firm*—Kelly, Bauersfeld & Lowry

[57] ABSTRACT

An improved locking assembly is provided for releasably locking a valve unit incorporated into a sprinkler housing or the like, wherein the locking assembly prevents the valve unit from being driven from the housing as a projectile by water under pressure at the upstream side of the valve unit. The valve unit includes a mounting ring normally held seated upon a shoulder seat within the base of the sprikler housing by the locking assembly including a stacked pair of snap rings installed into an enlarged housing lock groove thereby positioning a movable valve member in association with a valve seat to control water flow into the sprinkler housing. The valve unit is removable from the housing, for example, for maintenance purposes by removing the two snap rings one at a time. In the event the first snap ring is removed without prior relieving of water pressure at the upstream side of the valve unit, the water pressure lifts the valve unit from the valve seat to permit water flow into the housing while the second snap ring remains locked within the lock groove to block valve unit removal. When the water flow is turned off, the valve unit is removable quickly and easily by removal of the second snap ring.

16 Claims, 8 Drawing Figures

RELEASABLE LOCKING ASSEMBLY FOR SPRINKLER VALVE UNITS

BACKGROUND THE INVENTION

This invention relates to irrigation sprinklers particularly of the type including an internally mounted valve unit. More specifically, this invention relates to an improved locking assembly for releasably retaining a valve unit within a sprinkler housing or the like against becoming a water-driven projectile upon attempted valve unit removal, for example, for maintenance purposes, without first relieving water pressure at the upstream side of the valve unit.

Irrigation systems conventionally include a plurality of water sprinklers connected at predetermined positions to a water supply conduit for providing irrigation water to surrounding vegetation, such as grass, crops, and the like. Water under pressure is coupled to the water supply conduit and further to the sprinklers by appropriate manual or automated remote control operation of one or more control valves. In some irrigation system applications, particularly such as irrigation of golf course greens and the like, it may be desirable to connect the water under pressure within the supply conduit to the sprinklers one at a time or for individually timed watering cycles. In such applications, water sprinklers have been proposed to include an individual valve unit integrated into the base of each sprinkler housing for opening and closing the sprinkler housing to water inflow from the supply conduit, wherein the additional valve unit is typically adapted for convenient remote control operation. Exemplary of such water sprinklers including integrated valve units are the impact drive pop-up sprinklers currently marketed by Rain Bird Sprinkler Mfg. Corp. of Glendora, Calif. under the model designations 47 DR and 51 DR.

The integrated valve units incorporated into water sprinklers of the above-referenced type are commonly installed within the base of the sprinkler housing below a sprinkler spray head assembly typically of the so-called "pop-up" type. The valve unit commonly includes a control chamber into or from which water is bled to control the position of a movable valve member between open and closed positions. When the valve member is closed, water flow from the supply conduit into the sprinkler housing is preventing and the pop-up spray head assembly normally retracts to a concealed position within the sprinkler housing. Conversely, when the valve member is open, water under pressure flows into the sprinkler housing to elevate the spray head assembly for discharging water outwardly to irrigate surrounding vegetation. However, valve units of this general type are sometimes clogged by dirt, grit, and the like commonly present in many water supply systems, whereby periodic removal of the valve unit from the sprinkler housing is required for maintenance cleaning purposes.

In the past, to facilitate removal of a valve unit integrated into the base of a water sprinkler, the valve unit has been releasably seated in position by a simple snap ring. When valve unit maintenance is required, the pop-up spray head assembly is removed from above and the snap ring is removed quickly and easily to access the valve unit. However, it is sometimes possible to remove the snap ring without first relieving water pressure within the supply conduit at the upstream side of the valve unit, such as by closure of a main system control valve, whereupon the water pressure can drive the valve unit as a projectile from the water sprinkler creating a risk of injury to the person removing the snap ring. Attempts to alleviate this problem by providing interengageable undercut surfaces on the sprinkler housing and snap ring have not always prevented snap ring removal with the upstream side of the valve unit subjected to significant water pressure.

There exists, therefore, a significant need for an improved locking device for releasably securing a valve unit into the base of a sprinkler housing or the like, wherein the locking device permits facilitated valve unit removal while safeguarding against injury upon attempted valve unit removal prior to relieving water pressure at the upstream side thereof. The present invention fulfills these needs and provides further related advantages.

SUMMARY OF THE INVENTION

In accordance with the invention, an improved locking assembly is provided for releasably retaining a valve unit within the base of a sprinkler housing or the like. The locking assembly is designed for securely retaining the valve unit in position during normal valve unit operation for controlling water inflow to the sprinkler housing and for subsequent facilitated removal to correspondingly permit valve unit removal, for example, for maintenance purposes. Importantly, upon attempted removal prior to relieving water pressure at the upstream side of the valve unit, the locking assembly prevents the valve unit from becoming a water-driven projectile to safeguard the person removing the valve unit against injury.

In a preferred form of the invention, the locking assembly comprises first and second snap rings sized for stacked locked reception into an enlarged lock groove formed near the base of the sprinkler housing to retain the valve unit normally in seated relation upon a housing shoulder seat. The snap rings each include slightly spaced ends jointed to slightly spaced upstanding ears, with each snap ring being installed into the housing lock groove with its pair of upstanding ears rotated away from the ears of the other snap ring. The snap rings retain the valve unit in a position with a movable valve member in operative association with a valve seat on the sprinkler housing for controlling water inflow.

When it is desired to remove the valve unit for maintenance purposes or the like, the first and second snap rings are removed one at a time to release the valve unit for removal from the sprinkler housing. More particularly, the first or upper snap ring is removed from the lock groove by drawing together the pair of upstanding ears thereby reducing the diametric size of the snap ring. In the event this first snap ring is removed without prior relieving of water pressure at the upstream side of the valve unit, the water pressure displaces the valve unit and second snap ring upwardly from the valve seat within the limits of the lock groove to permit water flow upwardly through the sprinkler housing. However, the second or lower snap ring engages an axially upper end limit of the lock groove to block the valve unit against pressure-driven projection from the sprinkler housing. The person removing the snap rings is thus protected against injury and is alerted by the resulting valve-controlled water flow to turn off water flow to the sprinkler housing after which the valve unit is easily removed following removal of the second snap ring.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
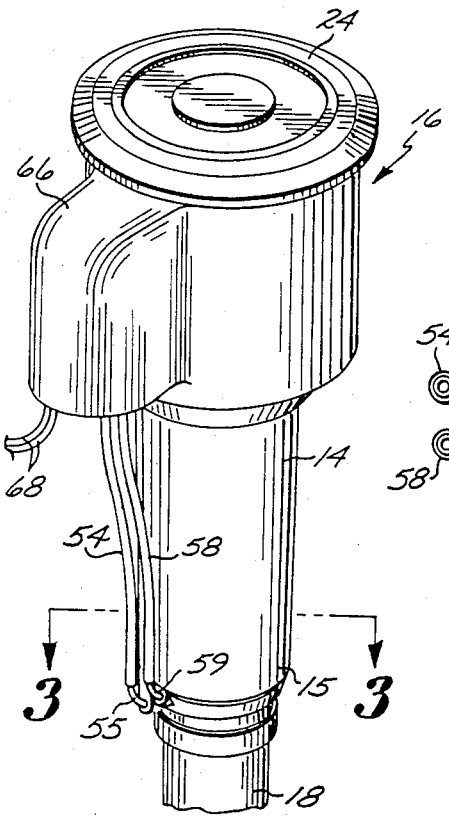
FIG. 1 is a fragmented perspective view of an irrigation sprinkler of a type including an integrated valve unit.

As shown in the exemplary drawings, an improved releasable locking assembly referred to generally by the reference numeral 10 is provided for releasably retaining a valve unit 12 in a normal operating position within a housing 14 of an irrigation sprinkler 16. The locking assembly 10 is designed for facilitated removal from the sprinkler housing 14 to permit access to the valve unit 12, for example, for maintenance purposes and the like. However, the locking assembly 10 further provides a relatively simple yet highly effective device for safeguarding the valve unit 12 from being ejected from the sprinkler housing as a water-driven projectile during an improper removal procedure.

The illustrative irrigation sprinkler 16 shown in FIG. 1 incorporates the valve unit 12 for individual water inflow control in accordance with operation of the valve unit 12. Such irrigation sprinklers are known for use in a variety of irrigation system applications, such as irrigation of golf course greens and the like, and are exemplified by the sprinklers currently marketed by Rain Bird Sprinkler Mfg. Corp. of Glendora, Calif., under the model designations 47DR, 51DR, 91DR, and 95DR. In such sprinklers, the sprinkler housing 14 conventionally comprises a generally cylindrical structure having a lower base 15 with a downwardly extending and internally threaded inlet fitting 17 adapted for connection to the upper end of a water supply standpipe or riser 18.

The valve unit 12 is integrated into the sprinkler housing 14 generally at the base 15 to control water flow upwardly into a hollow housing interior 20. A pop-up spray head assembly 22 or the like is typically installed within the housing interior 20 above the valve unit 12 and includes a hollow pop-up stem 21 carrying a suitable sprinkler spray head (not shown), such as an impact drive sprinkler, at the upper end thereof. When the valve unit 12 is closed, the pop-up assembly 22 is normally retained by a control spring 23 in a retracted position concealed within the sprinkler housing and a housing cover 24 (FIG. 1) closing the housing upper end. However, when the valve unit is moved to an open position, water is permitted to flow upwardly through the riser 18 and further past the valve unit 12 to drive the pop-up assembly 22 to an elevated position with the spray head above the ground, wherein the water is discharged outwardly from the spray head to irrigate surrounding vegetation, all in a manner well known to those skilled in the art of irrigation sprinklers.

As shown in the exemplary drawings, the illustrative valve unit 12 includes a valve member 26 of a resilient or elastomeric material and which is movably positioned with respect to a valve seat 28 at an inner end of the housing inlet fitting 17 to control water inflow to the housing interior 20 through an inlet port defined by the fitting 17. This valve member 26 has a generally annular shape including upwardly projecting feet 30 trapped between a pair of retainer plates 31 and 32 which also entrap a diametrically enlarged flexible diaphragm 34. The retainer plates 31 and 32 are held in clamping relation against the diaphragm 34 by a centrally apertured and internally threaded nut 36 which is threaded onto a downwardly projecting apertured central stud 38 of the upper retainer plate 32.

The peripheral margin of the diaphram 34 is entrapped between a lower annular clamping ring 40 and an upper, generally dome-shaped bonnet 42 by a series of screws 44 or other appropriate fastening means. As shown best in FIGS. 2 and 3, the bonnet 42 in turn includes a series of outwardly projecting peripheral support arms 46 joined to an outer mounting ring 48 of a size and shape for seated support upon an upwardly presented, annular shoulder seat 50 formed within the housing base 15. This shoulder seat 50 is located a short distance above and on a diameter significantly greater than the valve seat 28 to define an annular flow gallery 52 between the valve seat 28 and the diaphragm 34 and mounting ring 38. A first control tube 54 extends from the exterior of the housing 14 through a short fitting 55 and further through an extension 17' of the housing into an extension 34' of the diaphragm 34 to communicate with a control chamber 56 between the bonnet 42 and the diaphragm 34. A second control tube 58 extends from the housing exterior through a short fitting 59 into flow communication with the annular gallery 52.

Figure 2:
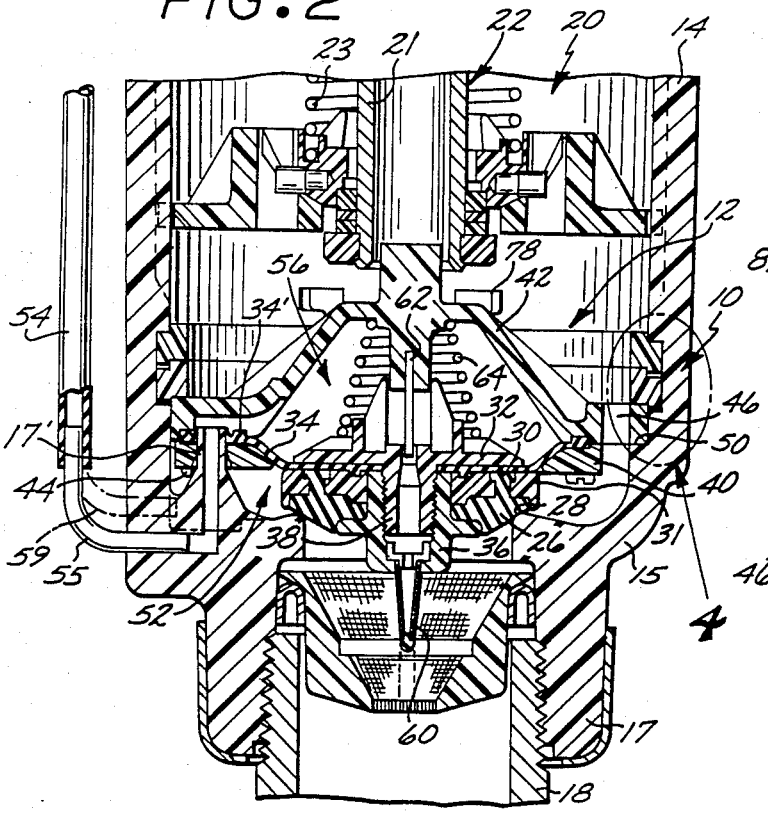
FIG. 2 is an enlarged fragmented vertical sectional view through a portion of the irrigation sprinkler of FIG. 1 and depicting an integrated valve unit retained releasably by a locking assembly embodying the novel features of the invention.
Figure 4:
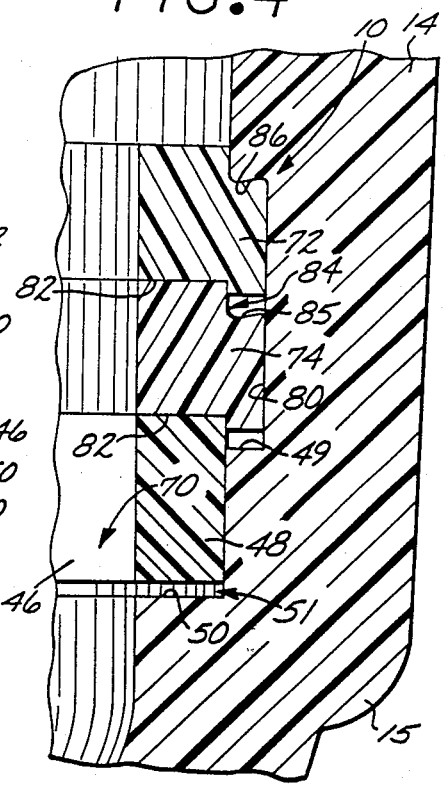
FIG. 4 is an enlarged fragmented vertical sectional view of a portion of the locking assembly corresponding with the encircled region 4 of FIG. 2.

In normal operation of the valve unit 12, a small quantity of water under pressure within the inlet fitting 17 bleeds through a relatively small filter 60 supported by or formed integrally with the centrally apertured nut 36 into the nut interior for bleed passage further through the stud 38 into the control chamber 56. A metering rod 62 carried by the bonnet 42 projects partially into the stud bleed passage to restrict water flow into the control chamber to a relatively slow flow rate. When the first fitting tube 54 is closed to prevent water discharge from the control chamber 56, the pressure within the control chamber equals the pressure within the inlet fitting 17 and cooperates with a closure spring 64 to retain the valve member in the closed position against the valve seat 28, as illustrated in FIG. 2.

The valve unit 12 is opened by connecting the first control tube 54 to a relatively low pressure drain. This is achieved by automated or manual override operation of a solenoid actuator (not shown) carried within a solenoid housing 66 at one side of the sprinkler housing 14 and electrically actuated via signal wires 68 to connect the first control tube 54 to the second control tube 58. In this manner, water under pressure within the control chamber 56 bleeds through the control tubes into the gallery 52, thereby partially relieving the total downward force on the diaphragm 34 and permitting water pressure at the upstream side of the valve member 26 to override the remaining closure force and open the valve member from the valve seat. This permits water flow into the annular gallery 52 and further through peripheral openings 70 between the radially extending support arms 46 for passage upwardly into the upper region of the housing interior 20 to elevate and operate the sprinkler spray head, as described above. The valve unit is returned to the closed position by appropriate operation of the solenoid actuator to again close the first control tube 54.

The foregoing description has set forth the construction and operation of the illustrative valve unit 12 in relatively general terms, since the valve unit 12 is of a construction generally known to those skilled in the art. See, for example, the description of similar solenoid-actuated valve units for use in irrigation systems, as set forth in U.S. Pat. Nos. 4,081,171 and 4,226,259 which are incorporated by reference herein.

Figure 3:
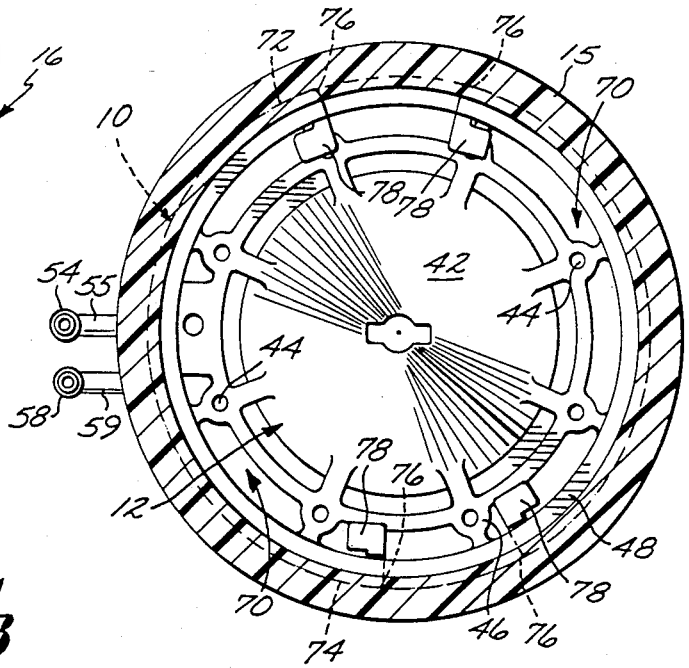
FIG. 3 is a horizontal section taken generally on the line 3—3 of FIG. 1.

As shown in FIGS. 2–8, the valve unit 12 is releasably and safely retained in position by the improved releasable locking assembly 10 including a stacked pair of snap rings 72 and 74. More particularly, the snap rings 72 and 74 are identical to one another and are formed preferably from a relatively stiff plastic material molded into a nearly complete circular shape to include a pair of arcuately closely spaced ends 76 (FIG. 3). These pairs of spaced ends 76 may be drawn toward one another to slightly reduce the diametric size of the snap ring and then released, after which the inherent structural stiffness returns the snap ring to its original diametric size. Conveniently a pair of upstanding ears 78 are formed at the spaced ends 76 of each snap ring to facilitate snap ring operation from above. As shown best in FIG. 4, the two snap rings 72 and 74 have a cross-sectional geometry for nested and stacked reception into a lock groove 80 in the housing base 15 hold the valve unit 12 in place. More particularly, each snap ring is formed with a lower face including a downwardly presented shallow annular recess 82 inset radially from the snap ring periphery. In addition, each snap ring has an upper face including an upwardly and radially outwardly open shallow annular channel 84 with a base surface 85 preferably set at a small outwardly inclined angle, such as on the order of about ten degrees.

The lock groove 80 in the housing base 15 comprises a radially inwardly open groove formed a short distance above and on a diameter greater than the housing shoulder seat 50. Moreover, the axial height of the lock groove 80 is sufficient to accommodate the two snap rings 72 and 74 in stacked relation. More specifically, the lower snap ring 74 is placed into the lock groove 80 with its lower recess 82 receiving the upper extent of the mounting ring 48 of the underlying valve unit 12, and with the snap ring 74 expanded substantially to its unstressed diametric size having an outer diameter conforming generally with the lock groove diameter and an inner diameter less than the outer diameter of the mounting ring 48. The upper snap ring 72 is then placed into the lock groove 80 with its lower recess receiving the upper extent of the underlying snap ring 74 and with its upper channel 84 seating the base surface 85 thereof against a generally complementary-shaped, undercut axially upper end limit 86 of the lock groove. In this position, the upper snap ring 72 is also expanded substantially to its unstressed diameter, and the relative axial sizes of the two snap rings and the mounting ring 48 accommodate a slight axial spacing between the lower snap ring 74 and the lower end limit 49 of the lock groove and further between the mounting ring 48 and the associated shoulder seat 50, as referred to by arrow 51. Moreover, the upper snap ring 72 is normally installed with its upstanding ears 78 rotated out of alignment with the lower snap ring ears to permit individual snap ring installation and removal, as will be described.

During normal sprinkler operation, the two snap rings 72 and 74 are locked into the housing lock groove 80 to releasably retain the valve unit 12 in operative association with the valve seat 28. Water under pressure is normally present within the supply riser 18 to act upwardly against the valve unit, thereby normally forcing the mounting ring 48 upwardly by the spacing 51 against the lower snap ring 74. Appropriate operation of the valve member 26 between closed and open positions, as described previously, respectively prevents or permits water inflow to the housing 14 thereby controlling sprinkler operation.

When removal of the valve unit 12 is desired, for example, to clean accumulated grit or the like from the filter 60, the sprinkler housing cover 24 and the associated pop-up spray head assembly 22 can be removed from above in a known manner. The valve unit 12 is then exposed from above for removal from the sprinkler housing.

Figure 5:
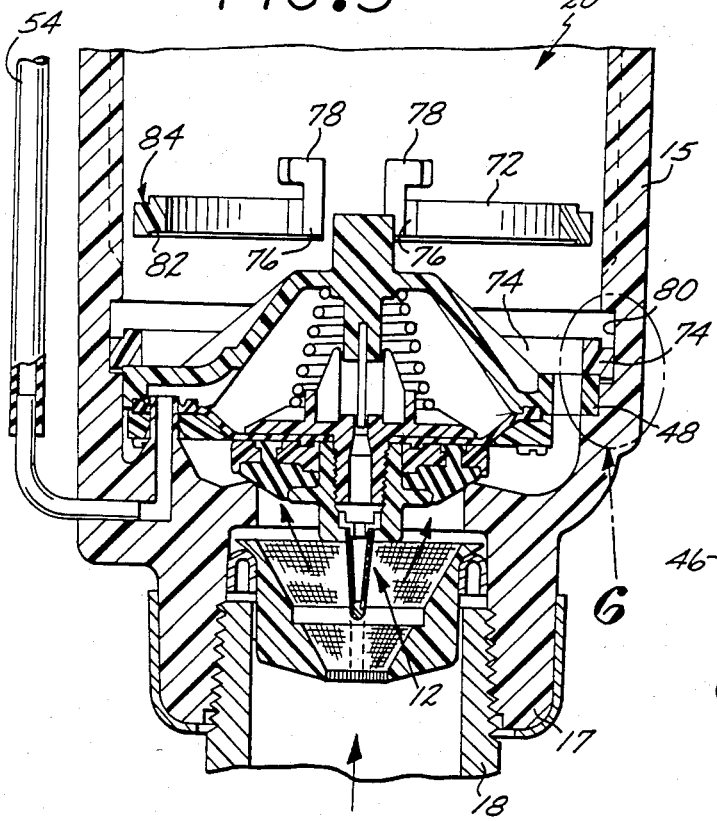
FIG. 5 is a fragmented vertical sectional view generally similar to FIG. 2 and illustrating a first step in the removal of the valve unit.
Figure 6:
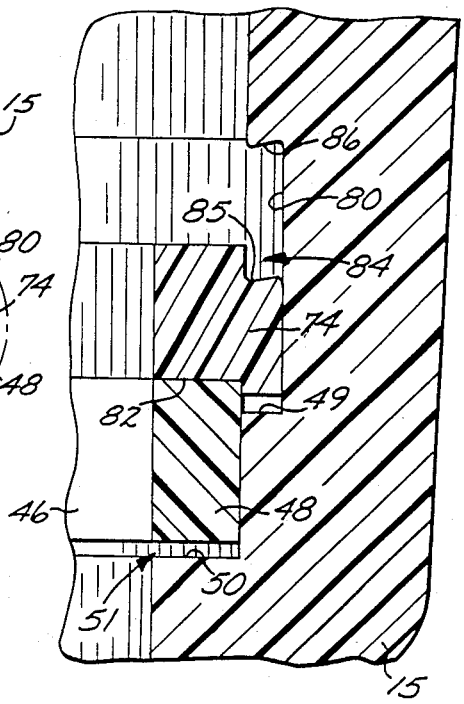
FIG. 6 is an enlarged fragmented sectional view corresponding with the encircled region 6 of FIG. 5.

To remove the valve unit 12, the first or upper snap ring 72 is removed by drawing the associated ears 78 adjacent spaced ring ends 76 toward one another to reduce the diametric size of the snap ring sufficiently for upward removal from the lock groove 80, as depicted in FIGS. 5 and 6. The removal of the snap ring is facilitated by pushing down on the valve 12 to disengage the interlocking features of the two snap rings while at the same time drawing the ends of the snap ring 72 together. This removal of the snap ring 72 is permitted notwithstanding the mating engagement between the ring base surface 85 and the groove upper end limit 86 by virtue of the compliance of the plastic materials and the lower spacing or clearance 51 beneath the mounting ring. Moreover, removal of the first snap ring 72 is possible in some circumstances even though the water pressure at the upstream side of the valve unit 12 has not been relieved, for example, by closure of a main control valve (not shown) or the like for the irrigation system.

Figure 7:
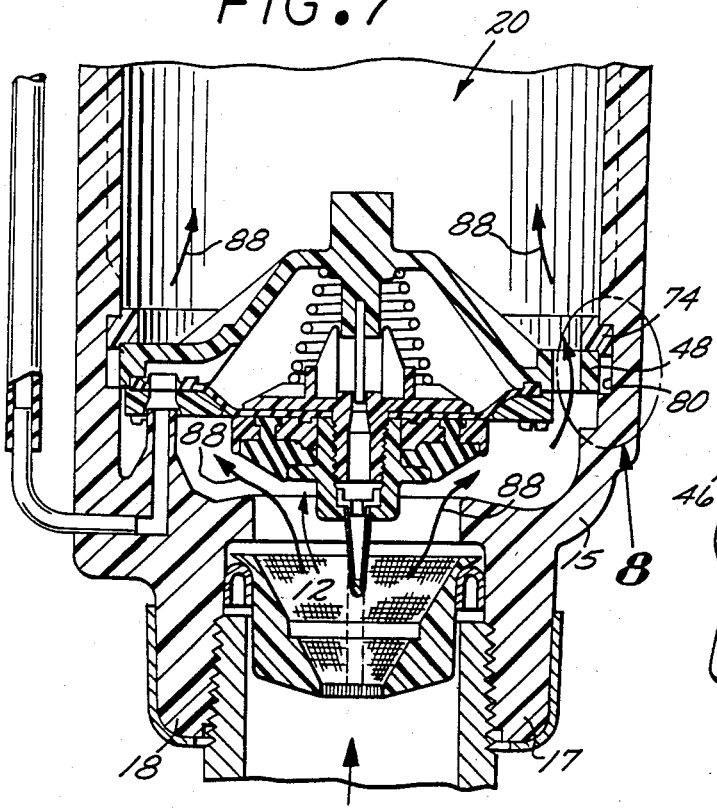
FIG. 7 is a fragmented vertical sectional view generally similar to FIG. 2 and illustrating operation of the locking assembly to prevent pressure-driven projection of the valve unit from the sprinkler.
Figure 8:
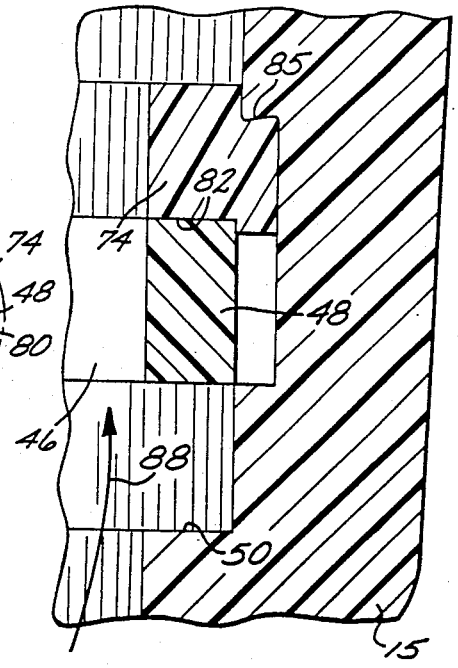
FIG. 8 is an enlarged fragmented sectional view corresponding with the encircled region 8 of FIG. 7.

In the event the first snap ring 72 is removed without prior relief of water pressure at the upstream side of the valve unit, such water pressure displaces the valve unit 12 upwardly from the valve seat 28, as viewed in FIGS. 7 and 8, thereby permitting water flow upwardly through the sprinkler housing 14, as indicated by arrow 88. This upward valve unit movement correspondingly carries the second or lower snap ring 74 upwardly within the limits of the housing lock groove 80 until the upper channel base surface 85 of the ring 74 reaches and locks with the upper end limit 86 of the lock groove. The second snap ring 74 thus halts upward valve unit movement to prevent the valve unit from being forced as a projectile from the sprinkler housing to possibly strike and injure the individual servicing the sprinkler.

After removal of the first snap ring 72, the copious continuing flow of water upwardly through the sprinkler housing 15 readily alerts the individual servicing the sprinkler that an improper removal procedure has been followed and that prompt closure of a main control valve or the like is required before the second snap ring 74 is removed. When the water pressure is relieved, the second snap ring 74 can be removed quickly and easily to permit unrestrained valve unit withdrawal upwardly from the sprinkler housing for the desired service. The valve unit 12 can then be reinstalled quickly and easily by return to the sprinkler housing and by reverse reinstallation one at a time of the snap rings.

The releasable locking assembly 10 of the present invention thus provides a simple, economical, and easily operated means for securely retaining the valve unit 12 in place throughout normal operation and for safeguarding against the valve unit becoming a pressure-driven projectile upon improper attempted valve unit removal.

A variety of modifications and improvements to the releasable locking assembly described herein are believed to be apparent to those skilled in the art. Accordingly, no limitation on the invention is intended, except as set forth in the appended claims.

What is claimed is:

1. A locking assembly for releaseably locking a valve unit within a sprinkler housing or the like in an operative position for opening and closing a pressurized water inlet port to control water flow into the housing, said locking assembly comprising:

shoulder seat means within the housing for supporting an upstream side of the valve unit when the valve unit is in the operative position;

a radially inwardly opening lock groove formed in the housing generally adjacent the side of the valve unit opposite said shoulder seat means when said valve unit is in the operative position, said lock groove having an upper end limit within the housing and spaced above the valve unit when the valve unit is in the operative position;

a plurality of snap rings releaseably engaged in vertically stacked relation within said housing lock groove, each of said snap rings having an upper and a lower generally radial face, said upper face of the upper of said plurality of vertically stacked snap rings being in abutting engagement with said groove upper end limit, and said lower face of the lower of said plurality of vertically stacked snap rings being engaged with said side of said valve unit opposite said shoulder seat means, each of said snap rings being independently releaseable from said lock groove;

whereby upon release and removal of at least one but less than all of said snap rings from said lock groove, the valve unit can move upwardly within the housing away from the operative position to an extent limited by engagement of said upper face of the upper remaining snap ring with said groove upper end limit thereby opening the pressurized water inlet port yet preventing removal of the valve unit from the housing until all of said remaining snap rings have been released and removed from said lock groove.

2. The locking assembly of claim 1 wherein said plurality of snap rings comprises a pair of said snap rings.

3. The locking assembly of claim 1 wherein each of said snap rings has a generally circular shape with a pair of arcuately spaced ends and a pair of ears upstanding respectively from said spaced ends.

4. The locking assembly of claim 1 wherein said snap rings include interlocking axial faces.

5. The locking assembly of claim 1 wherein said housing lock groove includes an undercut axial end limit generally opposite said shoulder seat means, and further wherein said generally radial upper face of each of said snap rings includes a radially and axially tapered locking surface for mating engagement with said undercut axial end limit.

6. The locking assembly of claim 5 wherein said snap rings when stacked present a combined axial dimension for engagement with at least some axial clearance within said housing lock groove.

7. The locking assembly of claim 1 wherein said snap rings when engaged within said housing lock groove have an outer diameter greater than the inner diameter of said lock groove and an inner diameter less than the outer diameter size of the valve unit.

8. In a pop-up sprinkler having a stationary housing with an upper open end and a lower closed and, and an inlet port to the housing adjacent the lower end and attachable to a source of pressurized water, a pop-up spray head assembly removably mounted within the housing for movement between an upper, operative position and a lower, inoperative position, a removable valve unit normally disposed in an operative position below the spray head assembly within the housing adjacent the inlet port, and having valve means movable between a first position closing the inlet port to prevent pressurized water from the source from entering the housing, and a second position opening the inlet port to admit pressurized water into the housing, and a locking assembly for releasably locking the valve unit in the operative position within the housing, said locking assembly comprising:

a radially inwardly opened lock groove formed in the housing above the inlet port, said lock groove having an upper end limit and an inner diametric size sufficient to permit removal of the valve unit upwardly from the housing;

an annular mounting ring formed on the valve unit and having an outer diametric size less than said inner diametric size of said lock groove;

first and second snap rings each having an upper and a lower generally radial face removably seated in vertically stacked relation within said lock groove, each of said snap rings having an unstressed outer diametric size greater then said inner diametric size of said lock groove and an inner diametric size less than said outer diametric size of said annular mounting ring;

said first and second snap rings overlying said annular mounting ring and cooperating to hold the valve unit in the operative position adjacent the inlet port within the housing with said upper face of said first snap ring abutting said groove upper end limit, said upper face of said second snap ring abutting said lower face of said first snap ring, and said annular mounting ring abutting said lower face of said second snap ring, whereby upon removal of one of said first and second snap rings from said lock groove when the valve means is in the first, closed position, the valve unit can move upwardly within the housing away from the operative position to an extent limited by engagement of said upper face of said other snap ring with said groove upper end limit thereby to effectively move the valve means to the second, open position while preventing removal of the valve unit from within the housing.

9. The locking assembly of claim 8 wherein each of said snap rings has a generally circular shape with a pair of arcuately spaced ends and a pair of ears upstanding respectively from said spaced ends.

10. The locking assembly of claim 8 wherein said snap rings include interlocking axial faces.

11. The locking assembly of claim 8 wherein said upper end limit of said housing lock groove includes an undercut axial end face, and further wherein said upper generally radial face of each of said snap rings includes a radially and axially tapered locking surface for mating engagement with said undercut axial end face.

12. The locking assembly of claim 11 wherein said snap rings when stacked present a combined axial dimension for engagement with at least some axial clearance within said housing lock groove.

13. The locking assembly of claim 8 wherein said snap rings are identical.

14. The locking assembly of claim 8 wherein each of said snap rings has a generally circular shape with a pair of arcuately spaced ends and a pair of ears upstanding respectively from said spaced ends.

15. The locking assembly of claim 8 wherein said snap rings include interlocking axial faces.

16. The locking assembly of claim 15 wherein said housing lock groove includes an undercut axial end limit generally opposite said shoulder seat means, and further wherein each of said snap rings includes a radially and axially tapered locking surface for mating engagement with said undercut axial end limit.

* * * * *